US009019116B2

(12) United States Patent
Pfannenberg

(10) Patent No.: US 9,019,116 B2
(45) Date of Patent: Apr. 28, 2015

(54) SIGNALING DEVICE COMPRISING AN AUDIO SIGNALING UNIT AND COMPRISING A LIGHT SIGNALING UNIT

(71) Applicant: Andreas Pfannenberg, Hamburg (DE)

(72) Inventor: Andreas Pfannenberg, Hamburg (DE)

(73) Assignee: Pfannenberg GmbH (DE)

( * ) Notice: Subject to any disclaimer, the term of this patent is extended or adjusted under 35 U.S.C. 154(b) by 94 days.

(21) Appl. No.: 13/682,968

(22) Filed: Nov. 21, 2012

(65) Prior Publication Data

US 2013/0127630 A1 May 23, 2013

(30) Foreign Application Priority Data

Nov. 22, 2011 (DE) ..... 10 2011 055 593

(51) Int. Cl.
*G08B 7/00* (2006.01)
*G08B 7/06* (2006.01)
*G08B 5/36* (2006.01)

(52) U.S. Cl.
CPC .... *G08B 7/06* (2013.01); *G08B 5/36* (2013.01)

(58) Field of Classification Search
USPC ..... 340/815.4, 693.5, 692, 286.02, 286.11, 340/332, 815.69, 815.47, 691.1, 4.13, 4.14, 340/7.61, 7.62, 7.63
See application file for complete search history.

(56) References Cited

U.S. PATENT DOCUMENTS 4,904,982 A * 2/1990 Lieb et al. ..... 340/326
5,132,659 A * 7/1992 Kuo ..... 340/326
5,825,280 A * 10/1998 Merendini et al. ..... 340/326
7,135,960 B2 * 11/2006 Arcaria et al. ..... 340/384.1
7,375,617 B2 * 5/2008 Stirling ..... 340/384.1
7,920,069 B2 * 4/2011 Shain et al. ..... 340/815.4

FOREIGN PATENT DOCUMENTS

CN 101128853 A 2/2008
WO 2008045692 A2 4/2008

OTHER PUBLICATIONS

WERMA Signaltechnik GmbH + Co. KG; 139, 439 Instruction manual, D-78604 Reitheim-Weilheim, Dec. 2, 2009, Company publication.

WERMA Signaltechnik GmbH + Co. KG; 439 Dimensional drawing, D-78604 Reitheim-Weilheim, Dec. 2, 2009, Company publication.

* cited by examiner

*Primary Examiner* — Toan N Pham
(74) *Attorney, Agent, or Firm* — McCormick, Paulding & Huber LLP

(57) ABSTRACT

A signaling device includes an audio signaling unit for emitting an acoustic signal and a light signaling unit for emitting a visual signal. A base housing body is provided, upon which the signaling device is arranged on an accommodating body. An upper housing part is provided, arranged on the base housing body, for forming a receiving space. The base body of the light signaling unit is formed of a light-transparent signal cap, that includes a base area which is spanned by a connection frame. The light signaling unit further includes an electrical switching unit, which is disposed in the connection frame. The base housing body includes a side wall, and the signal cap is attached to the outer side of the side wall with the base area and is disposed on the base housing body.

11 Claims, 2 Drawing Sheets

SIGNALING DEVICE COMPRISING AN AUDIO SIGNALING UNIT AND COMPRISING A LIGHT SIGNALING UNIT

CROSS REFERENCE TO RELATED APPLICATION

This application claims benefit of German Patent Application No. 102011055593.5, filed on Nov. 22, 2011, entitled "SIGNALING DEVICE COMPRISING AN AUDIO SIGNALING UNIT AND COMPRISING A LIGHT SIGNALING UNIT", herein incorporated by reference in its entirety.

DESCRIPTION

The present invention relates to a signaling device comprising an audio signaling unit for emitting an acoustic signal and comprising a light signaling unit for emitting a visual signal, wherein a base housing body is provided, by means of which the signaling device can preferably be arranged on an accommodating body, and wherein an upper housing part is provided, which is arranged on the base housing body for forming a receiving space.

STATE OF THE ART

Signaling devices comprising an audio signaling unit for emitting an acoustic signal and comprising a light signaling unit for emitting a visual signal, which, for example, can be part of a building protection unit, are known in general. Signaling devices, which are arranged on electrical devices, machines or industrial production facilities, are further known. Warnings can be output acoustically or visually by means of the signaling devices. Signaling devices, which send a visually perceivable light signal in addition to an acoustic audio signal, are mandatory in particular in an installation environment of the signaling device, in which a high noise level prevails. For this purpose, signaling devices are provided, which comprise the audio signaling unit as well as the light signaling unit in one structural unit.

In a disadvantageous manner, signaling devices comprising an audio signaling unit and a light signaling unit have a complex design and the assembly of such signaling devices is often made difficult. In the event that such signaling devices are used as part of the safety devices in a building, the signaling devices can be arranged on a wall, either in an in-wall mounting or in an on-wall mounting, and the establishing of the electrical connections must often be made with increased expenditure of time. In particular, the audio signaling unit and the light signaling unit are embodied on the signaling device as units, which must be assembled and electrically connected separately and which can often be attached by an assembler only after installation of the base housing body to the accommodating body, for example a wall. Once all of the electrical connections have been established, in particular also the electrical connection between the light signaling unit and the base housing body, the upper housing part can be attached to the base housing body and can be connected thereto. The upper housing part thereby forms at least one cover, so as to form a closed receiving space in the signaling device.

DISCLOSURE OF THE INVENTION

It is thus the object of the present invention, to create a signaling device comprising an audio signaling unit for emitting an acoustic signal and comprising a light signaling unit for emitting a visual signal, by means of which the above-identified disadvantages are overcome and which comprises a simple design and which can be installed easily.

A base body of the light signaling unit is formed of a light-transparent signal cap, wherein the signal cap comprises a base area, by means of which the signal cap is disposed on the base housing body.

By means of the embodiment of the light signaling unit according to the invention, a base housing body can be provided, comprising an upper housing part, which only comprises the audio signaling unit, and the light signaling unit comprises a (separate) base body, which is formed by the signal cap itself. Therefore, the light signaling unit need not be formed of a base body, onto which a signal cap, via which the visual signal is emitted, is placed only subsequently. The signal cap is the only component of the light signaling unit, which is visible from outside. The light signaling unit according to the invention is instead characterized by a smaller number of components, which can furthermore be connected to the base housing body of the signaling device in a simple manner.

In the context at hand, the term "light-transparent" signal cap is to be understood such that the signal cap is formed for allowing the light, which is emitted by an illuminant in the interior of the light signaling unit, to pass from the inside to the outside. The signal cap does not necessarily need to be made transparent, that is, lucent, but can instead also be made colored.

The base housing body of the signaling device comprises a side wall, and the signal cap is attached to the outer side of the side wall with the base area and is in particular connected to the side wall by means of connection means. According to the invention, the signal cap, which emits the light signal, is disposed on the base housing body in direct contact with the side wall. This advantage becomes possible, because the light signaling unit does not comprise a further base body, to which the signal cap must first be attached, because, according to the invention, the signal cap already forms the base body of the light signaling unit itself.

In the present case, the base body of the light signaling unit identifies the body, on which substantially all of the relevant components of the light signaling unit are disposed. The light signaling unit comprising the signal cap and the additional components can be considered to already be ready for operation inasmuch as only electrical connections, which for example, need to be connected only to a power supply and/or to a signal supply, for example, are guided out of the base body of the light signaling unit. A light signaling unit comprising the base body and the operationally necessary components, which must be disposed on the base body, is thus created as a self-contained and functional unit, which subsequently needs to only be disposed on and electrically connected to the base housing body of the signaling device.

The base area of the signal cap is spanned by means of a connection frame and the light signaling unit comprises an electrical switching unit, which is disposed in the area of the connection frame. The electrical switching unit, which serves as essential, functionally necessary unit for operating the light signaling unit, is thereby connected directly to the signal cap, before the signal cap itself is disposed on the side wall of the base housing body. The electrical connection, which is electrically connected to further components in the base housing body of the signaling device, can be guided out of the electrical switching unit. With the present understanding of the base area, the base area of the signal cap, which is spanned by the connection frame, does not need to extend in one plane, and the connection frame can deviate from one plane, for example, in that the connection frame comprises steps, recesses, edges and the like. Instead, according to the invention the connection frame of the signal cap is provided to serve the purpose of placing the signal cap onto the side wall of the base housing body, wherein the joining surface between the side wall and the signal cap does not need to lie in one plane and the base area of the signal cap can be adapted to the surface of the side wall. For example, the base area of the signal cap can be slightly smaller than the surface of the side wall. In the event that the signal cap is attached to the side wall of the base housing body in the disposed state, the electrical switching unit is already located on the signal cap, so that the light signaling unit can be disposed on the side wall of the base housing body substantially ready for operation.

In another object of this invention, the side wall of the base housing body can comprise an opening, into which the electrical switching unit extends at least partially, when the light signaling unit is disposed on the side wall. The electrical switching unit can be formed by means of a carrier circuit board, on which the electronic components are arranged. The carrier circuit board can be located in the base area of the connection frame or parallel to the base area of the connection frame, for example, and the carrier circuit board, but also components, which are arranged on the carrier circuit board, can extend into the opening in the side wall of the base housing body. The opening can be formed rectangularly, for example, and the opening can have smaller dimensions than the side wall of the base housing body. The connection frame can be attached circumferentially onto the edge of the opening in the base housing body, so that the opening in the base housing body is closed by means of the connection frame and thus by means of the signal cap.

In another aspect, the carrier circuit board, which forms the electrical switching unit, can be held in the connection frame of the signal cap by means of connection means. For example, the carrier circuit board can be screwed in the signal cap and the carrier circuit board can have smaller dimensions than the connection frame of the signal cap. In the event that the carrier circuit board is disposed on the inside of the signal cap, for example parallel to or in the base area of the signal cap itself, the signal cap can subsequently be disposed on the side wall so as to cover the opening in the side wall.

In a further aspect the light signaling unit comprises an illuminant, which is disposed in particular on the electrical switching unit and which projects into the signal cap. By means of the arrangement of the electrical switching unit, which is embodied as carrier circuit board, the illuminant, for example a flash lamp, can be disposed on the carrier circuit board in a simple manner. When the carrier circuit board is disposed in the signal cap, approximately in the area of the connection frame, the illuminant is in the desired position within the signal cap after disposing the switching unit in the signal cap. For example, the signal cap can be formed in the shape of a pyramid having a rectangular base area, and the illuminant is located in the center of the pyramid-shaped signal cap. The size of the pyramid is designed such that the base area of the pyramid covers the opening in the side wall.

A rope seal, which is placed in particular circumferentially into the connection frame, which is preferably formed rectangularly, can be disposed on the signal cap. In the event that the signal cap is disposed with its connection frame on the side wall above the opening, the rope seal seals the opening in the side wall, in particular when the signal cap is formed to be closed. It is prevented through this that moisture and/or contaminations can penetrate into the receiving space in the base housing body or also into the interior of the signal cap.

In another aspect a line connection means is disposed in the base housing body, wherein the electrical switching unit has an electrical connection to the line connection means. The electrical connection between the electrical switching unit and the line connection means can be guided through the opening in the side wall of the base housing body, to which the signal cap is attached. In particular, the electrical switching unit can be disposed in the opening itself, when the signal cap is disposed with the electrical switching unit on the side wall. Despite the opening in the side wall of the base housing body, this still results in a closed design, because the signal cap covers the opening completely. The electrical connection between the switching unit and the line connection means can have already been established by the assembler prior to the assembly of the signaling device, and the line connection means in particular serves the purpose of establishing an electrical connection between the signaling device and a further circuitry for wiring the signaling device. An electrical line can be guided through housing apertures, which can be placed into the base housing body.

In another aspect a further electrical component for sound generation is provided, which is disposed in particular on the upper housing part. The signaling device can thus comprise an electrical switching unit for wiring the illuminant of the light signaling unit as described, and the electrical switching unit is part of the light signaling unit. Furthermore, an electrical component assembly for sound generation, which is arranged on the inner side of the upper housing part in a particularly advantageous manner or which is held thereon, respectively, can be provided in the base housing body. A contacting means with a first plug-in contact partner and a second plug-in contact partner can be disposed between the electrical component assembly and the line connection means, and the first plug-in contact partner is located on the line connection means and the second plug-in contact partner is located on the electrical component assembly for sound generation. In the event that the upper housing part is disposed on the base housing body, the contacting means is produced by plugging the plug-in contact partners into one another.

The base housing body can have a depth of between 40 mm and 150 mm, preferably between 45 mm and 140 mm, and particularly preferably between 47 mm and 125 mm, for example. The upper housing part can furthermore have a depth of between 20 mm and 75 mm, preferably between 30 mm and 60 mm, and particularly preferably between 32.5 and 56 mm. In the assembled state on the base housing body, the upper housing part can project into the base housing body, so that the entire depth of the signaling device does not necessarily follow from the sum of the depths of the base housing body and the upper housing part. A ratio of the depth of the base housing body to the upper housing part of between 1.0 and 4.4, preferably between 1.4 and 4.1, and particularly preferably between 1.45 and 3.0 follows.

In addition, the light-emitting surface area of the signal cap can be between 60 $cm^2$ and 1000 $cm^2$, preferably between 100 $cm^2$ and 500 $cm^2$, and particularly preferably between 154 $cm^2$ and 420 $cm^2$. Simultaneously, the surface area of the base area can be between 40 $cm^2$ and 500 $cm^2$, preferably between 80 $cm^2$ and 300 $cm^2$ and more preferably between 94 $cm^2$ and 242 $cm^2$. This results in a ratio of the light-emitting surface area of the signal cap to the surface area of the base area of between 1.2 and 2.4, preferably between 1.4 and 2.0, preferably between 1.6 and 1.8. The light-emitting surface area comprises the entire surface of the signal cap, through which light can be emitted or can pass, respectively, to the outside. In the event that the signal cap is formed in a pyramid-shaped manner, for example, these are the four side surfaces of the pyramid body. Only the encasement surface must furthermore be considered here, and not the surface of the outer sides of the signal cap, for instance, which can be much larger in the case of structured surfaces. It is attained by means of this embodiment that a relatively large light-emitting surface area of the signal cap is provided, which results in a considerably improved heat dissipation. It is now furthermore possible to assemble the illuminant, for instance a flash lamp, so as to be upright instead of horizontally, whereby an improved light-emission effect is attained.

PREFERRED EMBODIMENT OF THE INVENTION

Further measures, which improve the invention, will be illustrated below in more detail together with the description of a preferred embodiment of the invention by means of the figures. Schematically, FIG. 1 shows a perspective view of an embodiment of a signaling device comprising an audio signaling unit and comprising a light signaling unit;

Figure 1:
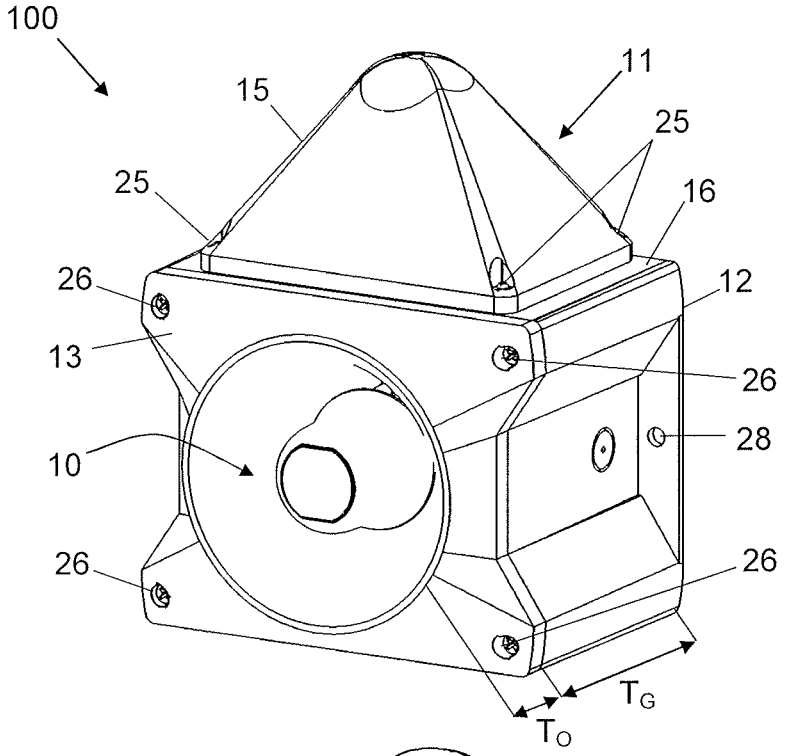

FIG. 1 shows a signaling device 100 according to the present invention in a perspective view. The signaling device 100 comprises an audio signaling unit 10, which is illustrated by means of an acoustic horn. In addition, the signaling device 100 comprises a light signaling unit 11, which is attached to a base housing body 12 of the signaling device 100. To attach the light signaling unit 11, connection means 25 are provided in the form of screws, by means of which the light signaling unit 11 is screwed to a side wall 16 of the base housing body 12.

The light signaling unit 11 has a base body, which is formed as signal cap 15. The signal cap 15 serves as the element, which emits the signal light, and an illuminant, by means of which the light signal is generated, can be placed into the signal cap 15. However, the signal cap 15 itself can also form the illuminant, for example when the signal cap 15 is formed as a planar emitter.

The base housing body 12 is closed by means of an upper housing part 13 and the audio signaling unit 10 is disposed on the inner side of the upper housing part 13. The upper housing part 13 can be connected to the base housing body 12 by means of locking pins 26. The locking pins 26 can be formed such that they are disposed on the upper housing part 13 in a self-retaining manner, and in the event that the upper housing part 13 is handled individually, an assembler does not need to also handle the locking pins 26 individually. To lock the upper housing part 13 to the base housing body 12, the locking pins 26 can be locked into openings 27, which are placed into the front side of the base housing body 12. See FIG. 2 with reference to this.

In addition, the base housing body 12 comprises holes 28, which are placed into fastening clips 29, which are molded on the outer side of the base housing body 12. Fastening means can be guided through the holes 28, so as to arrange the signaling device 100 with the base housing body 12 on an accommodating body.

The depth of the base housing body 12 is specified with $T_G$ and the depth of the upper housing part 13 is specified with $T_O$, wherein the depth $T_O$ of the upper housing part 13 can be larger than shown in the illustration, because the upper housing part 13 can project with a part of its depth $T_O$ into the base housing body 12. Without the light signaling unit 11, the housing of the signaling device 100 has a cube shape, for example, wherein the cube does not need to have the same edge lengths.

Figure 2:
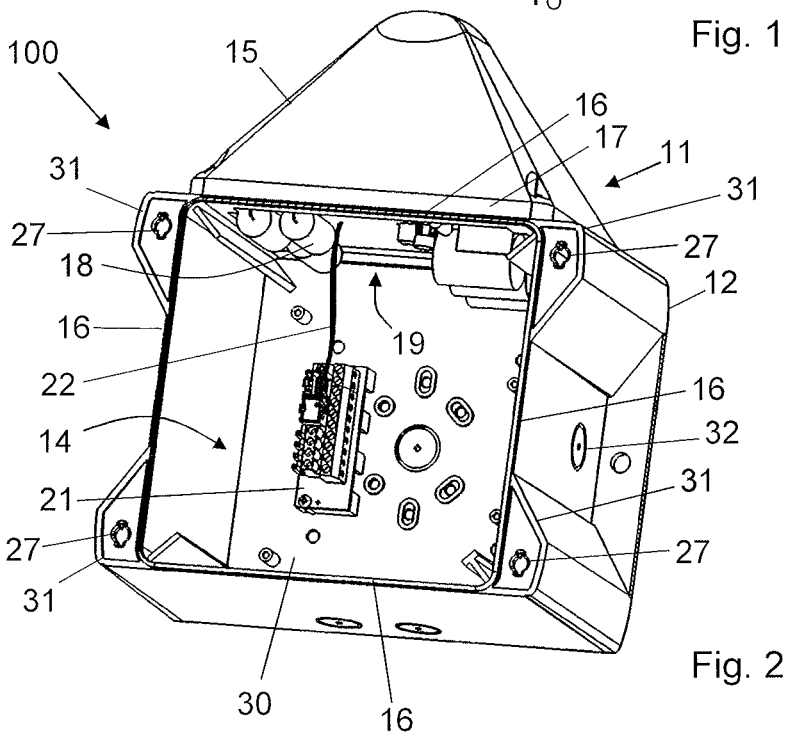
FIG. 2 shows the signaling device in an open state, in which the upper housing part is removed.

FIG. 2 shows the signaling device 100 in an open form, in which the upper housing part 13 is removed. In FIG. 2, the receiving space 14 is shown in the base housing body 12, and the base housing body 12 is formed by means of a housing bottom 30 and four side walls 16, which extend laterally on the rectangular housing bottom 30 in vertical direction. In the corner areas hollow chambers 31 are provided, which are molded to the side walls 16 on the outer side, into which the openings 27 for locking the locking pins 26 are placed on the front side.

The side wall 16, which is arranged on the top, comprises an opening 19, and the light signaling unit 11 comprising the signal cap 15 is disposed on the upper side wall 16. An electrical switching unit 18, which projects partially into the receiving space 14 of the base housing body 12 through an opening 19 in the side wall 16, is placed approximately into the base area of the pyramid-shaped signal cap 15. To connect the electrical switching unit 18, an electrical connection 22 comprising a line connection means 21 is shown, and electrical lines, which are guided through at least one housing wall 16 through corresponding housing aperture 32, can be connected to the line connection means 21.

The perspective view shows the signal cap 15 comprising a connection frame 17, with which the signal cap 15 is attached to the side wall 16 of the base housing body 12 on the outer side. The connection frame 17 forms a rectangular base area of the pyramid-shaped signal cap 15 and the electrical switching unit 18 is formed by means of a carrier circuit board, which extends approximately in the plane of the connection frame 17.

Figure 3:
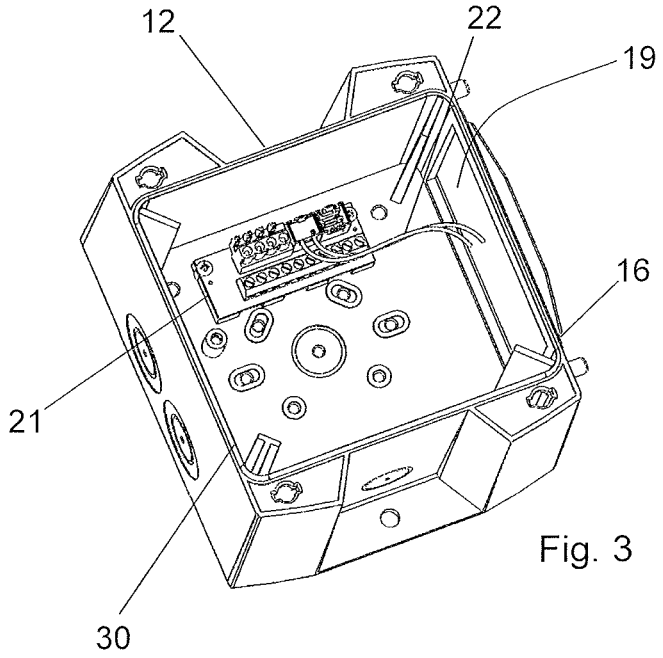
FIG. 3 shows a perspective view of an exemplary embodiment of the base housing body.

FIG. 3 shows a perspective view of the base housing body 12 comprising the line connection means 21, which is disposed on the housing bottom 30. A side wall 16 of the base housing body 12 comprises the opening 19, which has an approximately rectangular shape. In addition, the electrical connection 22, which is provided between the line connection means 21 and the light signaling unit 11, is indicated, said light signaling unit 11 being illustrated in more detail in FIG. 4 below.

Figure 4:
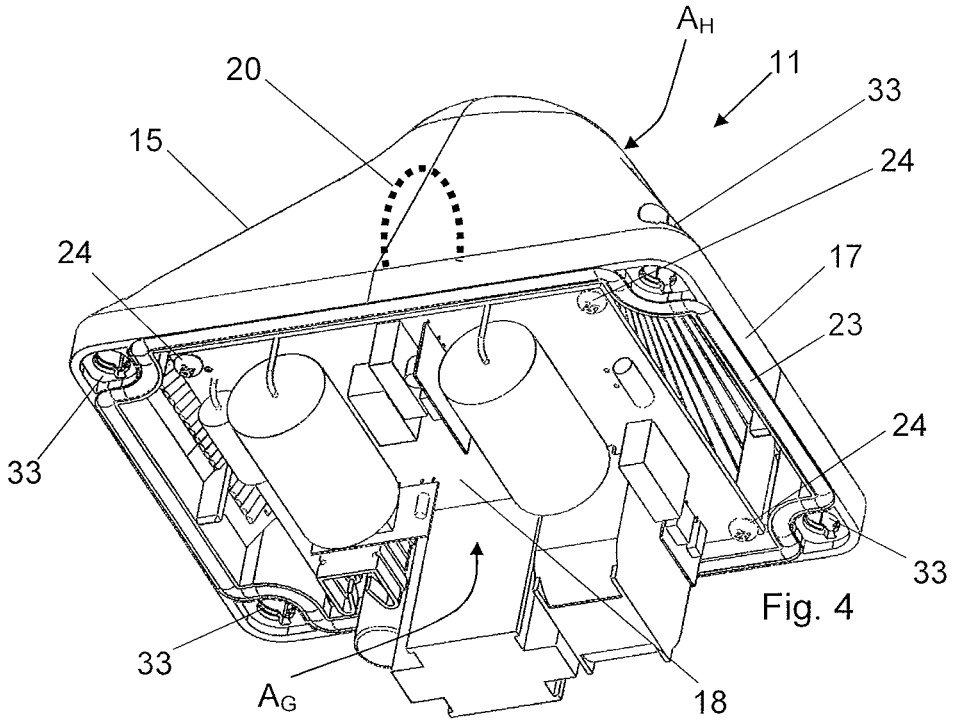
FIG. 4 shows a perspective view of the light signaling unit, as it is disposed on the base housing body.

FIG. 4 shows a perspective view of the light signaling unit 11. The base body of the light signaling unit 11 is formed by means of a signal cap 15, which has a pyramid shape. The base area of the pyramid is spanned by means of a connection frame 17, wherein the signal cap 15 is made of a light-transparent material. An electrical switching unit 18 is placed into the rectangular-shaped connection frame 17 of the signal cap 15 and is connected to the signal cap 15 by means of connection means 24. An illuminant 20, for example a flash lamp, which projects into the signal cap 15 by the arrangement of the electrical switching unit 18 in the connection frame 17 of the signal cap 15, is located on the electrical switching unit 18. When the illuminant 20 is put into operation, the emitted light can pass the signal cap 15 and can be perceived visually.

A rope seal 23, which has a closed contour so as to seal the opening 19 on the outer side of the side wall 16 by attaching the signal cap 15, is placed into the rectangular-shaped connection frame 17, see FIG. 3.

To provide the light signaling unit 11, the signal cap 15 can be initially provided, into which the electrical switching unit 18 is disposed on the bottom side and which is screwed by means of connection means 24, for example in the form of screws. The light signaling unit 11 can subsequently be attached to the side wall 16 of the base housing body 12 on the outer side and connection means 25 (see FIG. 1 with reference thereto) can be guided through connection means accommodations 33, so as to subsequently connect the signal cap 15 to the base body 12.

The light-emitting surface area of the signal cap 15 is indicated with $A_H$ and the surface area of the base area is specified with $A_G$.

The embodiment of the invention is not limited to the above-specified preferred embodiment. Instead, a number of alternatives is possible, which uses the illustrated solution even in the case of embodiments, which are different on principle. All of the features and/or advantages, which follow from the claims, the description or from the drawings, including structural details, spatial arrangements and method steps, can be significant for the invention, either alone as well as in a variety of combinations.

The invention claimed is:

1. A signaling device comprising an audio signaling unit for emitting an acoustic signal and a light signaling unit for emitting a visual signal, wherein a base housing body is provided, by means of which the signaling device can preferably be arranged on an accommodating body, wherein the base housing body comprises a housing bottom, wherein an upper housing part is provided, which is disposed on the base housing body for forming a receiving space, and wherein a base body of the light signaling unit is provided, said base body of the light signaling unit being formed of a light-transparent signal cap, wherein the signal cap comprises a base area, wherein the base area of the signal cap is spanned by a connection frame, wherein the light signaling unit comprises an electrical switching unit, which is disposed in the connection frame, wherein the electrical switching unit comprises a carrier circuit board, which extends substantially in the base area of the signal cap, wherein the base housing body comprises a side wall extending laterally on the housing bottom at a right angle, wherein the side wall comprises an opening, and wherein the signal cap is attached to the outer side of the side wall with the base area and is disposed on the base housing body so that the opening in the side wall is closed by means of the connection frame.

2. The signaling device according to claim 1, wherein the signal cap is connected to the side wall of the base housing body by means of connection means.

3. The signaling device according to claim 1 or 2, the electrical switching unit extends at least partially into the opening of the side wall.

4. The signaling device according to claim 1, wherein the carrier circuit board is held by means of connection means in particular in the connection frame of the signal cap.

5. The signaling device according to claim 1, wherein the light signaling unit comprises an illuminant, which in particular is disposed on the electrical switching unit and projects into the signal cap.

6. The signaling device according to claim 1, wherein the signal cap is formed in the shape of a pyramid having a rectangular base area and in that the signal cap covers the opening in the side wall.

7. The signaling device according to claim 1, wherein a line connection means is disposed in the base housing body, wherein the electrical switching unit comprises an electrical connection to the line connection means.

8. The signaling device according to claim 1, wherein an electrical component assembly for sound generation is provided, which in particular is disposed on the upper housing part and which in particular is disposed in the receiving space.

9. The signaling device according to claim 1, wherein a rope seal is disposed on the signal cap, said rope seal in particular being placed circumferentially into the connection frame, which is preferably formed rectangularly.

10. The signaling device according to claim 1, wherein the base housing body comprises a depth and wherein the upper housing part comprises a depth, in particular, wherein in particular the upper housing part in the assembled state on the base housing body projects into the base housing body, wherein the ratio of the depth of the base housing body to the depth of the upper housing part has a value of between 1.0 and 4.4, preferably between 1.4 and 4.1, and particularly preferably between 1.45 and 3.0.

11. The signaling device according to claim 1, wherein the signal cap comprises a light-emitting surface area and the base area comprises a surface area, wherein the ratio of the light-emitting surface area of the signal cap to the surface area of the base area is between 1.2 and 2.4, preferably between 1.4 and 2.0, and particularly preferably between 1.6 and 1.8.

* * * * *